United States Patent [19]

Betz et al.

[11] 4,053,678

[45] Oct. 11, 1977

[54] FIBER TOW FOR STUFFING PURPOSES AND PROCESS FOR PRODUCING IT

[75] Inventors: Helmut Betz; Geza Hidasi, both of Bobingen; Hans-Otto Vom Orde, Augsburg, all of Germany

[73] Assignee: Hoechst Aktiengesellschaft, Frankfurt am Main, Germany

[21] Appl. No.: 623,303

[22] Filed: Oct. 14, 1975

[30] Foreign Application Priority Data

Oct. 17, 1974 Germany ..... 2449408

[51] Int. Cl.[2] ..... B32B 27/00; D02G 3/00

[52] U.S. Cl. ..... 428/369; 28/263; 428/375; 428/391; 428/394; 428/395

[58] Field of Search ..... 428/375, 391, 394, 395, 428/396, 369, 370; 252/8.6, 8.9; 28/72.14

[56] References Cited

U.S. PATENT DOCUMENTS

| | | | |
|---|---|---|---|
| 2,731,367 | 1/1956 | Caroselli | 428/391 X |
| 2,838,455 | 6/1958 | Tompkins | 428/391 X |
| 3,271,189 | 9/1966 | Hofmann | 428/391 X |
| 3,399,079 | 8/1968 | Harris et al. | 428/394 |
| 3,423,314 | 1/1969 | Campbell | 428/391 X |
| 3,639,154 | 2/1972 | Sawa et al. | 428/395 X |
| 3,723,238 | 3/1973 | Werner et al. | 428/395 X |
| 3,853,607 | 12/1974 | Iyengar et al. | 428/395 X |

*Primary Examiner*—Lorraine T. Kendell
*Attorney, Agent, or Firm*—Connolly and Hutz

[57] ABSTRACT

A crimped fiber tow for stuffing purposes containing an ionic antistatic agent, at least one conditioning agent consisting essentially of a methyl hydrogeno polysiloxane, an alpha, omega hydroxy dimethyl polysiloxane, an emulsifier for the polysiloxanes, an Sn (II) salt of a fatty acid and high molecular weight polyethylene. The stuffing fibers are distinguished by the same soft and smooth feel as known from downs; they are more over easily displaceable one against the other and resume their bulkiness by being shaken up. The fiber tow and the fiber are therefore excellently suitable for stuffing cushions, quilts and upholstery goods.

2 Claims, 2 Drawing Figures

FIBER TOW FOR STUFFING PURPOSES AND PROCESS FOR PRODUCING IT

Figure 1:
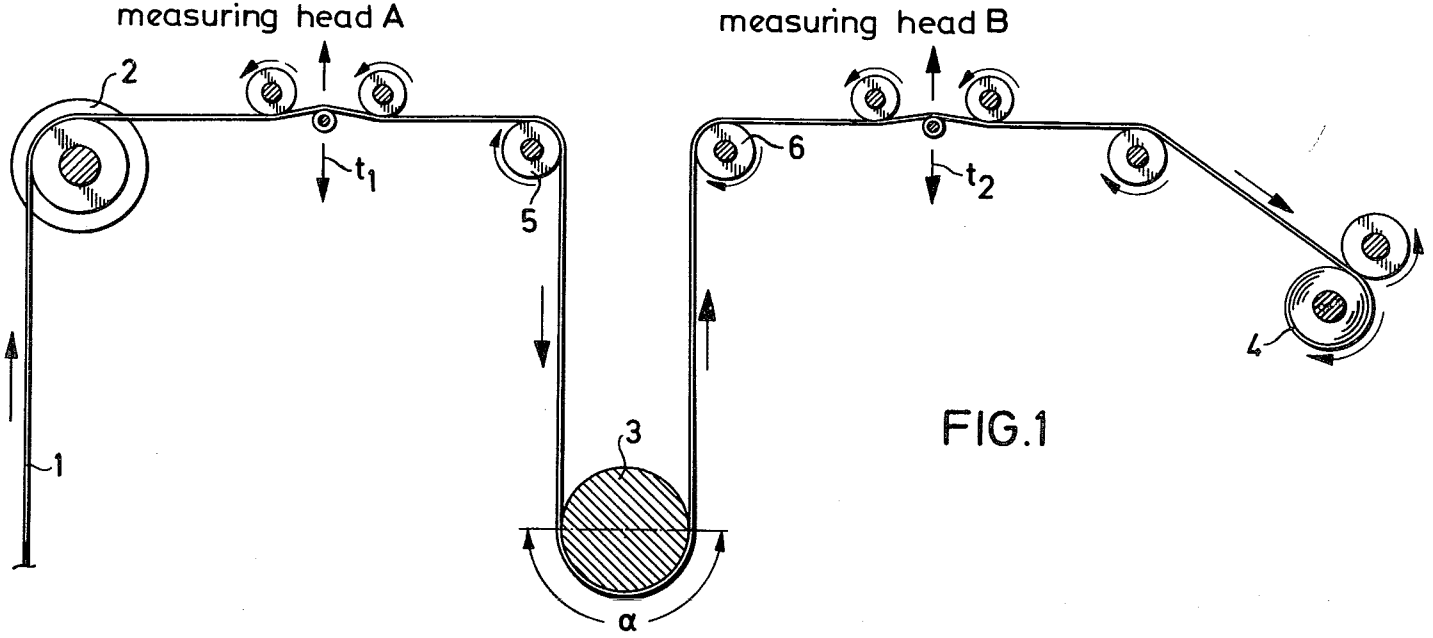

The present invention relates to a fiber tow made of synthetic high polymers that has been permanently conditioned to be fast to washing, and to a process for producing this tow suitable for stuffing purposes.

Feathers and downs have proved to be the best stuffing material for cushions and quilts of any type as well as for padded articles. Increasing demand, however, has long outgrown the limited possibilities of supplying these natural products that are not available in the required amounts. Attempts have therefore been made to find an adequate substitute, such as stuffing material made of cotton or wool, and in recent times, even of synthetic fibers, while trying to achieve, as far as possible, the known advantageous properties of downs for the synthetic stuffing material as well. These attempts include the production of stuffing material which consists of undivided fiber tows, has a very good warmth retention property, a minimum specific weight, further displays a high resilience, and its bulk is able to stand a high load.

A key requirement for those fiber tows is their internal mobility, i.e. the crimped separate capillaries must be easy to displace one against the other in the stuffing material. They must not stick to one another nor form major agglomerations.

A vital part for the production of those fiber tows for stuffing purposes is played by the type of conditioning treatment chosen which has to fulfill a variety of requirements. A conditioning agent used for this purpose has to impart a smooth, downy feel to the material. It must not allow the fibers to become compact but has rather to show a certain separating effect which enables it to prevent the fibers from sticking to one another. For hygienic reasons, resistance to bacteria, fungi and the like is also required. Moreover, the conditioning agent must not change the original properties of the tow. In addition to these requirements intended to impart downy properties to the synthetic tow by means of a suitable conditioning treatment, further efforts are being made to render the tows resistant to washing and dry cleaning. A conditioning finish to be used for this purpose must therefore have a good durability, i.e. it must not be altered nor washed off on repeated washing and/or cleaning operations nor must it cause shrinkage of non-quilted cushion stuffings. The above-cited properties, especially the downy mobility, have to be preserved unchanged after several washing operations.

According to German Auslegeschrift No. 1,444,034, it is known to produce crimped polyester staple fibers to be used as upholstery material or as bonded or unbonded padding material by treating the fibers with silicone resin which is cured at an elevated temperature under the action of an organometallic catalyst.

U.S. Patent Specification No. 3,454,422 and British Pat. Specification No. 1,257,974 disclose stuffing fibers that have been treated with dimethyl/methyl hydrogeno polysiloxans and a water-soluble copolymer of dimethyl polysiloxan and ethylene oxide.

Those known methods involve considerable costs; they are therefore not economical and are applied only on a minor scale. Moreover, the use of pure silicone imparts a hydrophobic finish to the stuffing fiber, which is disadvantageous when these fibers are to be used for quilt stuffing. Though this undesired hydrophobic property can be avoided by replacing the pure silicones by water-soluble copolymers derived from alkylene oxides, the finish then obtained on the fibers is not resistant to washing.

Therefore, the object of this invention was to develop a conditioning finish for synthetic stuffing fibers, which does not include the said drawbacks but shows good economy and durability.

It has now been found that a fiber tow of synthetic high polymers suitable for stuffing purposes is obtained by applying, after the primary spinning operation, onto the filaments an aqueous conditioning agent A1 containing from 0.05 to 0.3% by weight of an anionic antistatic agent, adjusting the aqueous pick-up to a 15 - 25% weight increase, storing the filaments thus treated in cars, again applying a conditioning agent A1 of the same constitution as the first-applied agent A1 or of a constitution differing therefrom within the scope defined above, adjusting the aqueous pick-up to a 15 - 25% weight increase, drawing the filaments at a ratio of from 1:3 to 1:4.5 under heat, preferably at temperatures of from 90° to 110° C, applying onto the drawn threads an aqueous conditioning agents A2 containing from 0.1 to 0.4% by weight of a methyl hydrogeno polysiloxan of a viscosity of from 25 to 35 cP at 20° C, from 0.2 to 0.8% by weight of an alpha-omega hydroxy dimethyl polysiloxan of a viscosity of from 600 to 1,000 cP at 20° C, from 0.02 to 0.1% by weight of an emulsifier for the polysiloxans, and from 0.01 to 0.5% by weight of a Sn(II) salt of a fatty acid having 8 to 18 carbon atoms; one or more of the conditioning agents A1 and A2 containing from 40 to 95% of high-molecular-weight polyethylene, calculated on the total weight of non-aqueous constituents, and optionally an emusifier for the polyethylene, and the condititioning agent A2 being fed in at such a rate that the total pick-up of non-aqueous constituents, calculated on the weight of the fibers, ranges from 0.2 to 1%, crimping the fiber tow in a stuffer box, drying and fixing it at 130° - 210° C for 30 seconds to 20 minutes, and finally storing the fiber tow thus finished or cutting it into staple fibers.

For the production of the fiber tows of the invention, any filaments made of synthetic high polymers, such as acrylonitrile polymers, polyamides, polyvinyl chloride and, especially, high-molecular-weight linear polyesters, such as polyethylene glycol terephthalate, are suitable.

The aqueous conditioning agent A1 is applied in two steps, the constitution of this agent for the two steps optionally being different but preferably identical. This conditioning agent preferably contains from 0.1 to 0.25% by weight of an antistatic agent and, advantageously, from 1 to 2% by weight of a high-molecular-weight polyethylene that is finely divided in water with 2 to 15% by weight of emulsifier, calculated on polyethylene. The polyethylene should have a medium molecular weight of from 10,000 to 25,000, preferably from 16,000 to 20,000 (softening point: 125° - 130° C). Suitable polyethylene dispersions are known, for example, from German Patent Specification No. 1,495,804.

The anionic antistatic agent has to meet a number of requirements: It must not have a negative effect on the subsequent drawing of the fiber tow, it has to prevent a troublesome accumulation of electrostatic charge and to improve the running properties of the fibers.

The electric surface resistance may be taken as a measure for preventing the accumulation of electrostatic charge. For this purpose, a measuring thread made of polyethylene glycol terephthalate having an intrinsic viscosity of 0.65, a dtex titer of 5,000/860, a length of 20 cm and a non-aqueous antistatic pick-up of 0.25% at a relative atmospheric moisture of 65% and at 22° C, should have a low resistance of from $5 \times 10^8$ to $5 \times 10^9$ Ohm.

The running properties of the fiber can be defined by the dynamic threaded-metal friction (sliding friction) and by the static friction (threaded-thread friction). These species may be determined by means of measuring threads of polyethylene glycol terephthalate, intrinsic viscosity being 0.65, dtex 280 f 48, non-aqueous antistatic pick up 0.25%:

The sliding friction (dynamic thread-metal friction) is determined by means of the measuring arrangement described hereinafter.

The measuring arrangements used according to the present invention as shown diagrammatically by way of example in the accompanying drawings.

In the drawings, FIG. 1 is a cross-sectional view of an arrangement for measuring the sliding friction.

Figure 2:
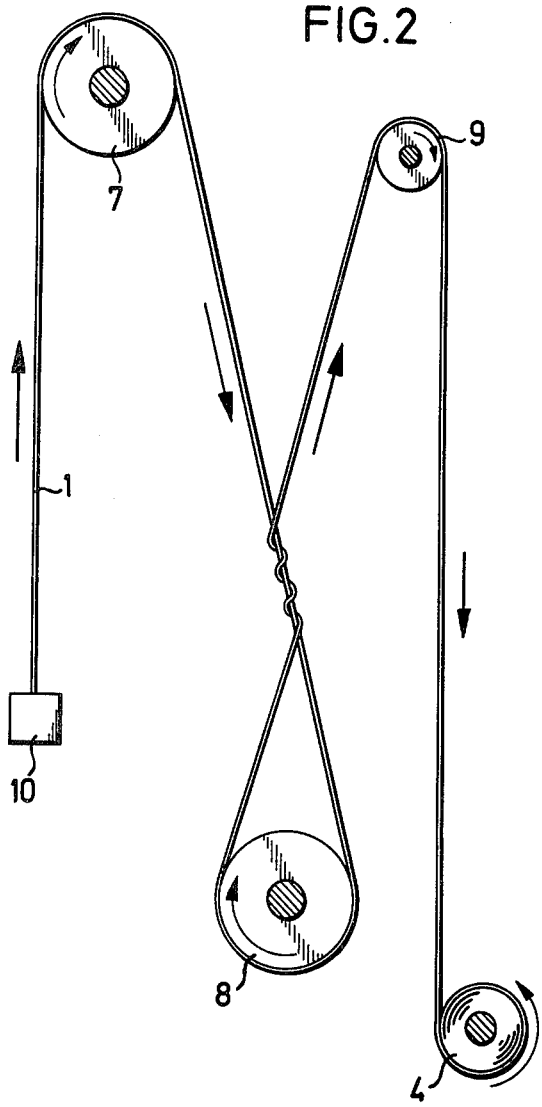

FIG. 2 is a cross-sectional view of an arrangement for measuring the static friction.

In FIG. 1, a filament 1 runs from the thread feeder through a thread break 2, that brings about a constant pretension of 50 p, to a first measuring head A and then over a friction element 3 made of chromium-plated high-grade steel to a second measuring head B, from which the filament runs to a thread receiver 4.

The dynamic friction coefficient $f$ results from thread tensions $t_1$ (prior to friction element (3)) and $t_2$ (after friction element 3) according to the equation:

$$f = 1/\alpha\,(\ln t_2 - \ln t_1)$$

$\alpha$ being the looping angle adjusted by means of thread guides 5 and 6 to 180°. The value for the dynamic friction (thread-metal friction) is the average obtained from measured values at drawing-off rates of from 20 to 120 m per minute.

The value $f$ ranges from 0.3 to 0.5 (22° C, 50% of relative atmospheric moisture) for the preferably used anionic antistatic agent.

The static friction is determined by means of the measuring arrangement described as follows:

In FIG. 2, a thread 1 to be measured is passed via rollers 7 and 8 to a measuring head 9 and then to a thread receiver 4, the thread that passes from roller 8 to measuring head 9 being wound three times around the thread passing from roller 7 to roller 8. The loose thread end is attached to a counterweight 10 of 13 gms, and the thread receiver is adjusted to a running speed of 6.7 mm/min. The friction resistance caused on the wound-around portions of the thread is established through the differences in thread tension by means of the measuring head and expressed in scale parts (that are proportional to these tension differences). The measured value ranges from 10 to 15 scale parts (22° C, 50% of rel. atm. moisture).

The conditioning agent A1 is applied in known manner, for example by immersion with the aid of drawing cylinders or rotating rollers. The desired amount of aqueous agents applied of 15 to 25%, preferably 18 to 22%, in particular 20%, in weight increase may by adjusted by centrifuging or squeezing the material.

Prior to the crimping operation, the aqueous conditioning agent A2 preferably containing from 0.1 to 0.3% by weight of methyl hydrogeno polysiloxan, from 0.3 to 0.5% by weight of $\alpha$, $\omega$-hydroxy dimethyl polysiloxan, from 5 to 15% of an emulsifier for the siloxans, calculated on the weight of the siloxans, from 4 to 10% of Sn(II) salt, calculated on the weight of the siloxans, and optionally from 1 to 2% by weight of high-molecular-weight polyethylene, and from 2 to 15% of an emulsifier for polyethylene, calculated on the weight of polyethylene, is applied on the drawn threads.

The conditioning agent A2 is fed in at such a rate that the total pick-up of non-aqueous constituents, calculated on the weight of the fiber, ranges from 0.2 to 1%, preferably from 0.3 to 0.7%.

The filaments thus treated are then given a stable two- or three-dimensional crimping that may be brought about according to known methods. Two-dimensional crimping may be produced, for example according to the stuffer box method. Suitable methods for providing a three-dimensionally crimped fiber tow is a differing pre-orientation caused by physical means by chilling one side of the filament after the melt-spinning process, for example by means of cooling elements (Swiss Patent Specification No. 488,032), cold rollers (Belgian Patent Specification No. 769,431) or by chilling by means of an air jet (French Patent Specification No. 1,257,932) and subsequent development of the latent crimping thus produced, or by chemical means on the basis or different chemical structures present in the so-called bicomponent threads (Compilation: P. A. Koch, Faserstofftabellen "Bikomponentenfasern", edition February 1970, Z. ges. Textilindustrie 72, 253 (1970)).

The crimping operation is followed by a drying and fixing operation at temperatures of from 130° to 210° C, preferably of 135° to 150° C, taking 30 seconds to 20 minutes, preferably 8 to 12 minutes. During the fixing process, the polyethylene applied melts. The silicone resulting from the silicone precursors and having a lower specific weight than polyethylene is supposed to migrate toward the surface of the conditioning finish to spread thereon and bring about the intended durability. It is assumed that the emulsifier(s) largely distribute over the polyethylene phase, which again solidifies after fixation, and contribute to certain hydrophilic properties.

The amount of energy required for drying and fixing may be supplied in the usual manner, for example by exposure to rays or heated rollers, preferably to hot air or steam.

The finished filament tow thus obtained may be processed further as endless tow and used as such, or it may be cut to staple fibers having a length of from 20 to 100 mm. In any case, its processing will be easy.

The fiber tow of the invention may have a total titer of from 200,000 to 1,200,000 dtex, preferably from 300,000 to 800,000 dtex, with an individual titer of from 3 to 40 dtex, preferably 3.5 to 10 dtex. It is characterized by a content of from 0.15 to 0.7% by weight of high-molecular-weight polyethylene, from 0.015 to 0.15% by weight of an anionic antistatic agent, and from 0.05 to 0.3% by weight of polysiloxan.

The stuffing fibers obtained according to the invention are distinguished by the same soft and smooth feel as known from downs; they are moreover easily displaceable one against the other and resume their bulkiness by being shaken up. The constituents of the composition, polyethylene and silicone, do not lead to agglomeration nor are they eliminated or affected in their efficiency upon repeated washing or dry cleaning. They are resistant to bacteria, fungi and to the action of other micro-organisms. The fiber tow and the fiber are therefore excellently suitable for stuffing cushions, quilts and upholstery goods. Owing to their especially favorable hygienic properties, they are particularly useful for hospital beds.

Compared with hitherto known conditioning agents used for stuffing fibers on the basis of silicones, the finish according to the invention is far less expensive but nonetheless produces a stuffing fiber having good utility. As results from the following experimental comparison, modifications of the conditioning agent of the invention provide useless stuffing fibers. For example, sticking capillaries and thus a useless product are obtained by replacing the high-molecular-weight polyethylene by a low-molecular-weight polyethylene as proposed, for example, in German Auslegeschrift No. 1,131,878 or French Patent Specification No. 1,413,324. If, on the other hand, the still reactive siloxan precursors of the invention are replaced by a higher-molecular-weight dimethyl polysiloxan, the finish is not permanent. If, however, polyethylene is not used, the conditioning agent obtained is practically not resistant to washing and dry cleaning.

The following Examples illustrate the invention, the parts, ratios and percentages being by weight unless mentioned otherwise.

EXAMPLE 1

Capillaries having a titer of 14.6 dtex were spun from the melt of a high-molecular-weight linear polyethylene glycol terephthalate, the filaments were conditioned at 25° - 30° C on rotating drawing cylinder disks with the below-mentioned conditioning agent A1, and after having been combined in bands, they were stored in cans. The bands showed, with a water content of about 20% and a non-aqueous pick-up of about 0.33%, the desired constitution and the antistatic behavior suitable for further processing.

The conditioning agent A1 consisted of:

1.4% of high-molecular-weight polyethylene having a softening point of 127.5° C and a medium molecular weight of from 16,000 to 20,000, which was dispersed with 0.15% of a mixture of equal parts of nonylphenol decapolyglycol ether and technical-grade sodium oleate in 98.35% of fully demineralized water.

At the fiber band line, 150,000 spun capillaries were taken from the cans and continuously treated for a second time with the conditioning agent A1. This agent A1 was placed in a tub in which the tow band was plunged under tension for 10 seconds at 62° C and then squeezed off to present a residual moisture of 20 ± 1%. Subsequently, the tow was drawn under heat at a ratio of 1:3.65 to present a separate capillary titer of 4.0 dtex. Prior to being let into the stuffer box, the tow band was passed under tension over a roller that plunged into another conditioning agent A2 (temperature 25° to 30° C) and turned at 10 r.p.m. in processing direction. The tow was then crimped in a stuffer box.

The conditioning agent emulsion A2 contained 0.4% of $\alpha$, $\omega$-hydroxy dimethyl polysiloxan, viscosity 800 cP at 20° C, 0.2% of methyl hydrogeno polysiloxan, viscosity 30 cp at 20° C, 0.05% of nonylphenol decapolyglycol ether, 0.03% of tin(II) stearate, and 99.32% of fully demineralized water.

The crimping operation in the stuffer box was followed by a fixing of the tensionless tow band during 10 minutes at 140° C, i.e. above the softening point of (unblended) polyethylene.

A two-hour Soxhlet extraction of a towband sample using toluene resulted in a conditioning agent pick-up of about 0.5%, calculated on the weight of the tow band.

The low-friction conditioning finish was resistant to washing and dry cleaning. After a treated pillow had been washed even 10 times at 40° C or 5 times at 60° C, it resumed its unchanged bulkiness after being shaken up and showed an unaltered bulk elasticity. The same positive results were observed with quilts containing a spread-out tow band. All the other properties corresponded to those of quilts stuffed with downs which, however, have the drawback, compared to the stuffing fibers of the invention, that they cannot be cleaned by means of aqueous washing liquors. Moreover, the natural fat of the downs only stands a few dry cleaning operations as compared to the fiber tows opened according to the invention.

Comparative Example (a)

The tow band was produced as in Example 1.

The spinning and drawing conditioning agent A1 was, however, replaced by the conditioning agent B of the following constitution:

1.5% of low-molecular-weight polyethylene having a softening point of 102° C and a medium molecular weight of 1,000 to 1,200, which was dispersed with 0.15% of a misture of equal parts of nonylphenol decapolyglycol ether and a technical-grade sodium oleate, in 98.35% of fully demineralized water.

After drawing, the tow band was wetted with the conditioning agent emuslion A2 according to Example 1, crimped and fixed.

Soxhlet extractions using toluene resulted in conditioning agent pick-ups of about 0.5%, calculated on the weight of the tow band.

A tow band produced according to Example 1 and treated with the conditioning agents B and A2 was spread out to stuff pillows and quilts. The stuffing showed irregular portions, stuck and hard capillaries in the tow band and were thus useless.

The tow band treated with the conditioning agents B and A2 had no downy property. The cushion stuffing was neither soft nor showed low-friction properties, nor was a recovery observed after shaking up. Tow-stuffed cushions and quilts could not be washed at 60° C since the conditioning agent B was scaled off from the surface of the capillaries. During the dry cleaning operation, the low-molecular-weight polyethylene of conditioning agent B was also eliminated.

Comparative Example (b)

The tow band was produced as in Example 1.

For the primary spinning process and prior to drawing, the conditioning agent A1 was used.

For the wetting operation on the roller, prior to crimping in the stuffer box, the conditioning emulsion C was used which contained 0.6% of dimethyl polysiloxan having a viscosity of 350 cSt., 0.5% of nonylphenol decapolyglycol ether, 0.03% of tin(II) stearate, and 99.32% of fully demineralized water.

Soxhlet extractions of tow band samples using toluene resulted again in a pick-up of 0.5% of conditioning agent, calculated on the weight of the tow.

The tow band produced for comparison using conditioning agent C was spread out and used for stuffing cushions and quilts. The stuffing showed at first a downy behavior, softness and resilience.

This conditioning agent C showing a good gliding property was, however, not resistant to washing or dry cleaning. After a cushion had been washed for the first time at 40° C, the tow stuffing packed together, while the conditioning agent pick-up had dropped to 0.1%. The condition of the cushion corresponded to that of a cushion stuffed with downs that had been washed at 40° C.

EXAMPLE 2

Capillaries were spun from a melt of a high-molecular-weight linear polyethylene glycol terephthalate, the filaments were conditioned as in Example 1 with conditioning agent A1, and after having been united to spun bands they were stored in cans.

At the fiber band line, a total of 100,000 spun capillaries taken from the cans were united to a tow that was again conditioned with conditioning agent A1, drawn under heat to reach an idividual capillary titer of 8.0, conditioning agent A2 was applied as in Example 1, the tow was crimped in a stuffer box, fixed for about 2 minutes at 200° C, and the tow band was stored in packages. The product obtained had the same properties as described in Example 1.

EXAMPLE 3

Capillaries having a titer of dtex 14.6 were spun from a melt of a high-molecular-weight linear polyethylene glycol terephthalate, the filaments were conditioned with the conditioning agent A1 specified hereinafter at 25° - 30° C on rotating drawing cylinder disks, united into spun bands and stored in cans. Having a water content of about 20% and a pickup of non-aqueous substances of about 0.05%, the bands showed the desired consistency and the antistatic behavior required for further processing.

Conditioning agent A1 consisted of
0.24% of N-oleyl sarcoside sodium in
99.76% of fully demineralized water.

At the fiber band line, 150,000 spun capillaries were taken from the cans and continuously treated for a second time with conditioning agent A1. The conditioning agent A1 was placed in a tub, into which the tow band was plunged for 10 seconds at 62° C under tension and then squeezed off to reach a residual moisture content of 20 ± 1%. The tow was then drawn under heat at a ratio of 1:3.65 to reach an individual capillary titer of 4.0 dtex.

Before being admitted to the stuffer box, the tow band was passed under tension over a roller that plunged into another conditioning agent A2 (temperature 25° - 30° C) and rotated at 10 r.p.m. in the processing direction. The tow was then crimped in a stuffer box.

This conditioning agent emulsion A2 contained:
1.5% of high-molecular-weight polyethylene, softening point 127.5° C and a medium molecular weight of 16,000 to 20,000, which was dispersed with
0.15% of a mixture of equal parts of nonylphenol decapolyglycol ether and a technical-grade sodium oleate,
0.4% of $\alpha,\omega$-hydroxy dimethyl polysiloxan (as in Example 1)
0.2% of methyl hydrogenopolysiloxan (as in Example 1),
0.05% of nonylphenol decapolyglycol ether,
0.03% of tin(II) stearate, and
97.67% of fully demineralized water.

The crimping operation in the stuffer box was followed by a fixing of the tensionless tow band during 10 minutes at 140° C, i.e. above the softening point of the (unblended) polyethylene. A two-hour Soxhlet extraction of a tow band sample using toluene resulted in a pick-up of the conditioning agent of about 0.4%, calculated on the weight of the tow band.

The conditioning agent which brought about a good gliding behavior was resistant to washing and dry cleaning. The bulk-resuming capacity on shaking up as well as the elasticity of the bulk remained unchanged even after a cushion stuffed with the treated tow had been washed ten times at 40° C or five times at 60° C. The same positive results were obtained with quilts containing a spread-out tow band treated with the conditioning agents A1 and A2. All these essential properties corresponded to those of the quilts stuffed with downs.

EXAMPLE 4

The procedure was the same as in Examples 1 and 3, but the conditioning agent A1 for spinning consisted of an anionic antistatic agent resistant to rotting:
0.24% of a mixture of mono- or di-octanol phosphate-diethanol amine salts and
99.76% of fully demineralized water.

The ratio of mono- and di-octanol phosphate-diethanolamine salts was about 25:75%.

Prior to drawing, the tow was treated in a tub with the same conditioning agent A1. On a roller, the conditioning agent emulsion A2 was applied in the manner described in Example 3.

The tow obtained had a pick-up of 0.5% of conditioning agent, which showed the desired properties for the stuffings of quilts, cushions and upholstery goods.

Comparative Example (c)

As described in Examples 1 and 3, the capillaries having a titer of dtex 14.6 were conditioned, during the spinning operation and on the fiber band line, with a conditioning agent A1 prior to drawing.

The conditioning agent A1 consisted of
0.24% of N-oleyl sarcoside sodium in
99.76% of fully demineralized water.

At the band line, the tow band was passed under tension, prior to being admitted to the stuffer box, over a roller which applied another conditioning agent A2. The tow was then crimped in a stuffer box.

This second conditioning agent emulsion A2 contained:
0.4% of $\alpha,\omega$-hydroxy dimethyl polysiloxan of a viscosity of 800 cP at 20° C,
0.2% of methyl hydrogeno polysiloxan (30 cP at 20° C),
0.05% of nonylphenol decapolyglycol ether,
0.03% of tin(II) octoate, and
99.32% of fully demineralized water.

The crimping operation in the stuffer box was followed by a fixing of the tensionless tow band during 10 minutes at 140° C.

A two-hour Soxhlet extraction of a tow sample using toluene resulted in a pick-up of about 0.4% of conditioning agent, calculated on the weight of tow band.

The conditioning finish was resistant to washing and dry cleaning, although stuffed pillows and quilts could not be washed:

Already after a first washing operation, the bulk resuming property on shaking-up and the bulk elasticity were lost as a result of the collapsing tow stuffing.

We claim:

1. A drawn, crimped and fixed fiber tow of synthetic high polymer fibers having an individual capillary titer of from 3 to 40 dtex, an ionic antistatic agent and 0.2 - 1% by weight of the fibers of the non-aqueous constituents of a conditioning agent consisting essentially of 0.1 - 0.4% by weight of a methyl hydrogeno polysiloxane having a viscosity of 25 - 35 cP at 20° C, 0.2 - 0.8% by weight of an alpha, omega-hydroxy dimethyl polysiloxane of a viscosity of 600 - 1,000 cP at 20° C, 0.02 - 0.1% by weight of an emulsifier for the polysiloxanes, 0.01 - 0.5% by weight of an Sn(II) salt of a fatty acid having 8 - 18 carbon atoms and 40 - 95% of high molecular weight polyethylene.

2. A drawn, crimped and fixed fiber tow of synthetic high polymer fibers having an individual capillary titer of from 3 to 40 dtex, impregnated with (1) an aqueous conditioning agent A1 containing 0.05 - 0.3% by weight of an anionic antistatic agent to an aqueous pick-up of a weight increase of 15 - 25%, and impregnated with (2) an aqueous conditioning agent A2 comprising 0.1 - 0.4% by weight of a methyl hydrogeno polysiloxane having a viscosity of 25 - 35 cP at 20° C, 0.2 - 0.8% by weight of an alpha, omega-hydroxy dimethyl polysiloxane of a viscosity of 600 - 1,000 cP at 20° C, 0.02 - 0.1% by weight of an emulsifier for the polysilxoanes, and 0.01 - 0.5% by weight of an Sn(II) salt of a fatty acid having 8 - 18 carbon atoms, at least one of said aqueous conditioning agents A1 and A2 containing 40 - 95% of high molecular weight polyethylene, said fiber tow containing by weight thereof 0.2 - 1% of the total amount of the non-aqueous constituents of said conditioning agent A2.

* * * * *